United States Patent [19]

Mochida et al.

[11] 4,327,623

[45] May 4, 1982

[54] REFERENCE FREQUENCY SIGNAL GENERATOR FOR TUNING APPARATUS

[75] Inventors: Yasunori Mochida; Terumoto Nonaka; Osamu Hanagasaki, all of Hamamatsu, Japan

[73] Assignee: Nippon Gakki Seizo Kabushiki Kaisha, Hamamatsu, Japan

[21] Appl. No.: 135,700

[22] Filed: Mar. 31, 1980

[30] Foreign Application Priority Data

Apr. 12, 1979 [JP] Japan ..... 54/44543
Apr. 12, 1979 [JP] Japan ..... 54/44544

[51] Int. Cl.[3] ..... G10G 7/02

[52] U.S. Cl. ..... 84/454; 84/1.01; 84/DIG. 18

[58] Field of Search ..... 84/454, 1.01, DIG. 18; 364/703

[56] References Cited

U.S. PATENT DOCUMENTS 4,053,739 10/1977 Miller et al. ..... 364/703
4,078,469 3/1978 Calvin ..... 84/454
4,114,496 9/1978 Deutsch ..... 84/1.1
4,215,616 8/1980 Gross ..... 84/1.01

*Primary Examiner*—B. Dobeck
*Assistant Examiner*—Forester W. Isen
*Attorney, Agent, or Firm*—Koda and Androlia

[57] ABSTRACT

A reference frequency generator for a tuning apparatus comprising a variable frequency divider which frequency divides a source signal in accordance with frequency division data stored in one or more ROM's. The frequency division data comprises note data for specifying frequencies of respective notes in one octave of a musical scale, pitch deviation data for specifying pitch deviation of the respective notes in one octave with respect to the frequencies specified by said note data and tuning curve data for specifying tuning characeristics covering several octaves, so that the generator generates reference frequency signals representing various pitch deviations and tuning characteristics as well as a standard tuning pitch or characteristic.

6 Claims, 5 Drawing Figures

REFERENCE FREQUENCY SIGNAL GENERATOR FOR TUNING APPARATUS

BACKGROUND OF THE INVENTION

1. Field of the Invention

This invention relates to a circuit which generates reference frequency signals to be used in the tuning of various musical instruments, and more particularly to a reference frequency signal generator for a tuning apparatus capable of generating reference frequency signals which are based on various tuning characteristics.

2. Prior Art

Heretofore, in a musical instrument tuning apparatus, a reference frequency signal generator utilizing an analog circuit arrangement has been known in which the circuit constants of inductances (L), capacitances (C), resistances (R), etc. are varied so as to obtain various reference frequencies. Although this known generator has the advantage that the variations of the reference frequency can be made continuous, it has such disadvantages that the stability and precision of the reference frequency are low, to make it practically impossible to tune a musical instrument as accurately as within +1 cent, so that if it is desired to generate the reference frequencies in accordance with the changes of the pitch or different tuning curves, the circuit constants L, C, R, etc. need to be changed by referring to a correction value table or the like each time, which is troublesome in procedure and requires much time as well as much labor, and that since the range of the reference frequencies which can be generated is comparatively narrow, it is often required to tune a specific tone first with the tuning apparatus and thereafter to tune a desired tone with reference to the tuned specific tone so that the efficiency of the tuning job is lowered and the tuning precision as a whole is also lowered.

SUMMARY OF THE INVENTION

Accordingly, the primary object of this invention is to provide a novel reference frequency signal generator for a tuning apparatus which is free from the above disadvantages.

More particularly, an object of the invention is to provide a reference frequency generator capable of selectively generating reference frequency signals of various tuning characteristics with simple operation and sufficient accuracy.

According to one embodiment of this invention, there is provided a reference frequency generator circuit wherein frequency change ratio (frequency division ratio or frequency multiplication ratio) data corresponding to necessary reference frequencies, also including data corrected in accordance with various pitches or tuning curves, are stored in a memory device in advance, a variable frequency oscillator circuit being controlled in compliance with the frequency change ratio data read out from the memory device, so as to obtain a desired reference frequency signal.

According to another embodiment of this invention, there is provided a reference frequency generator circuit comprising a first memory device which stores therein frequency change ratio (frequency division ratio or multiplication ratio) data serving as references, a second memory device which stores therein data required for corrections that are to be applied to the frequency change ratio data serving as references in accordance with changes of pitches or tuning curves, and an arithmetic circuit which operates the data read out from the first and second memory devices and forms frequency change ratio data corresponding to a necessary reference frequency, a variable frequency oscillator circuit being controlled in accordance with the output data from the arithmetic circuit so as to obtain a desired reference frequency signal.

The above-mentioned features and objects of the present invention will become more apparent with reference to the following description taken in conjunction with the accompanying drawings, wherein like reference numerals denote like elements.

DETAILED DESCRIPTION OF THE INVENTION

Figure 1:
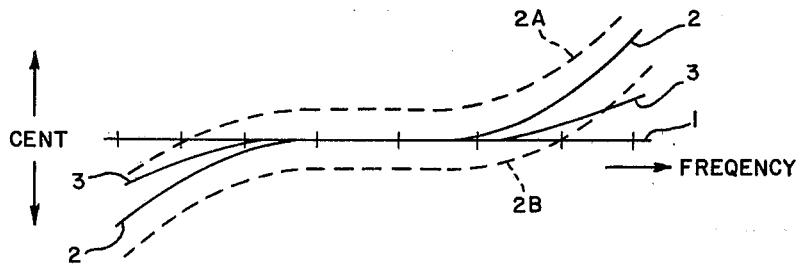
FIG. 1 is a graphical diagram showing examples of tuning curves available in a tuning apparatus according to an embodiment of this invention.

Referring now to FIG. 1, there are shown various tuning characteristics covering a range of seven octaves, which are available with a tuning apparatus according to an embodiment of this invention. The abscissa represents the frequency based on an equal temperament scale, while the ordinate represents the extent of deviation of a frequency to be given by the tuning, in terms of a cent value. Numeral 1 designates a flat tuning curve in accordance with the equal temperament, numeral 2 a tuning curve similar to that used in tuning of a piano in which tuning notes are lowered in the lower octaves and raised in upper octaves relative to the equal temperament, symbol 2A or 2B a tuning curve where the curve 2 is shifted upwards or downwards by setting pitches to be high (for example, $A_4$=444 Hz) or low (for example, $A_4$=436 Hz), respectively, and numeral 3 another tuning curve in which the deviations is upper and lower octaves are more moderate than in curve 2.

Figure 2:
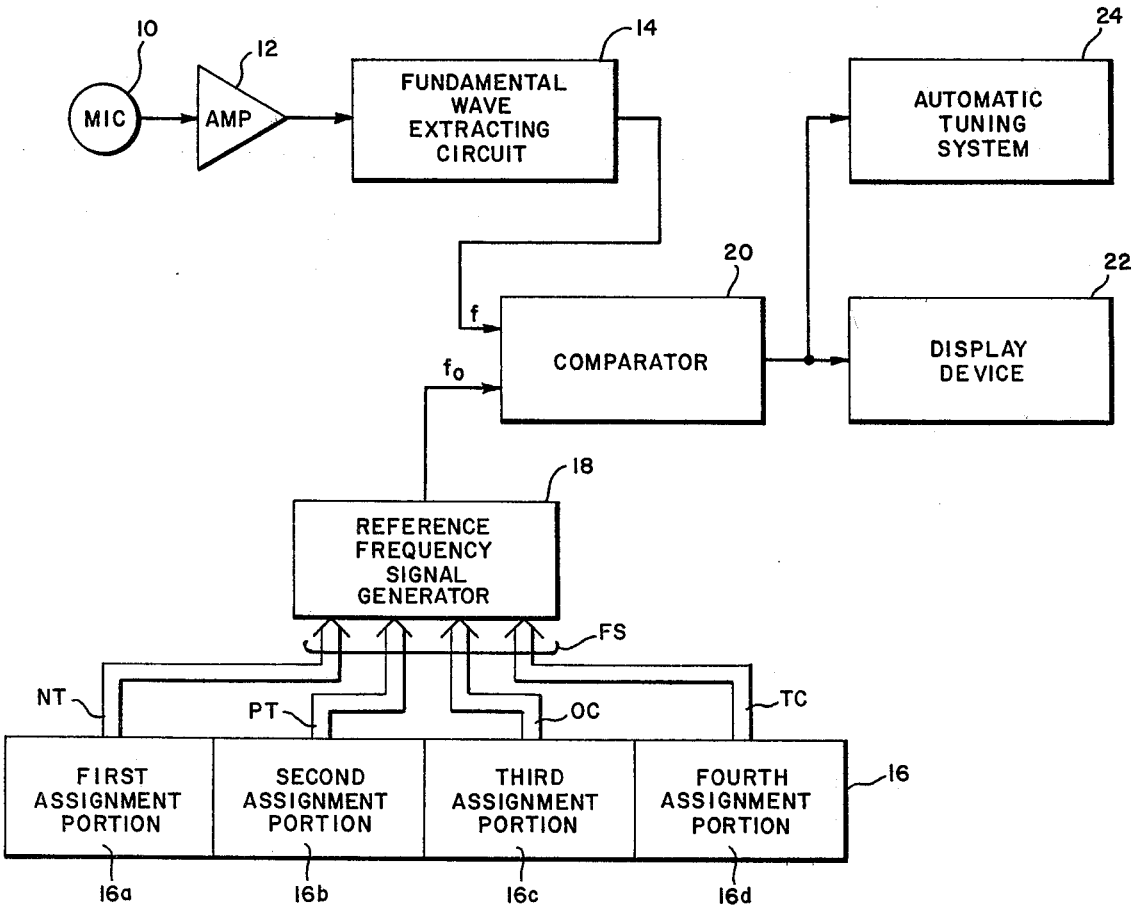
FIG. 2 is a block diagram showing the tuning apparatus according to an embodiment of this invention.

FIG. 2 shows a tuning apparatus according to an embodiment of this invention which is capable of demonstrating the various tuning characteristics as described above. Numeral 10 designates an acoustical-electrical transducer such as microphone which picks up a tone of a musical instrument to be tuned and converts it into a corresponding electric signal. This signal is amplified by an amplifier 12 which also includes a filter (not shown) for removing high frequency noise etc. from the output signal of the acoustical-electrical transducer 10. The filtered and amplified signal is introduced into a fundamental wave extracting circuit 14 which extracts the fundamental wave signal from the output signal of the amplifier 12. A fundamental wave extracting circuit such as is disclosed in the U.S. patent application No. 915,758, now U.S. Pat. No. 4,198,606, filed by the same assignee, may be used as the circuit 14. Numeral 16 indicates a frequency assignment operation circuit which includes a first assignment portion **16*a* for specifying a note in a musical scale or octave comprising twelve notes, a second assignment portion 16b for specifying a pitch deviation, a third assignment portion 16c for specifying an octave, and a fourth assignment portion 16d for specifying a tuning curve, and which delivers to a reference frequency specifying signal FS consisting of a note specifying signal NT, a pitch deviation specifying signal PT, an octave specifying signal OC and a tuning curve specifying signal TC in response to the operations of switches such as key switches incorporated in the operations of switches such as key switches incorporated in the operation circuit 16. The reference frequency signal generator generates a signal $f_o$ of a reference frequency determined by the reference frequency specifying signal FS, the details of which will be described later with reference to FIG. 3**.

The fundamental wave signal f delivered from the fundamental wave extracting circuit 14 and the reference frequency signal $f_o$ delivered from the reference frequency signal generator 13 are compared by a comparator 20, which supplies a display device 22 or an automatic tuning system 24 with a comparison output corresponding to the difference between the comparison inputs f and $f_o$. The display device 22 displays digitally the deviation of the frequency f to be tuned with respect to the reference frequency $f_o$ in terms of, for example, a cent value, while the automatic tuning system 24 automatically drives or adjusts tuning parts in the musical instrument such as tuning pins in a piano, so as to minimize the deviation of the frequency-to-be-tuned f from the reference $f_o$.

Thus, according to the tuning apparatus of FIG. 2, by appropriately operating the key switches in the frequency assignment operation circuit 16, it is possible to generate the reference frequency $f_o$ suited to the desired tuning characteristic for each note in each octave, to detect the deviation between this reference frequency $f_o$ and this frequency-to-be-tuned f, and to use the deviation signal for the display or the automatic tuning.

Now, the details of the reference frequency signal generator will be described with reference to FIG. 3. A variable frequency oscillator circuit 30 comprises a stable fixed oscillator 32 such as a quartz oscillator, and a variable frequency divider 34 constructed of a programmable counter which divides a frequency signal $f_s$ generated from the oscillator 32, by a frequency division ratio indicated by frequency division ratio data DS as a control input thereof. A frequency signal $f_T$ delivered from the variable frequency divider 34 is appropriately subjected to a frequency division in octave by an octaval frequency divider 36. A gate circuit 38 derives frequency signals from the respective frequency division stages of the frequency divider 36 in accordance with the octave specifying signal OC supplied from the frequency assignment operation circuit 16 in FIG. 2. It operates so that, regarding the top octave, the frequency signal $f_T$ may be derived as it is, while regarding lower octaves, the frequency signals ($\frac{1}{2}$, $\frac{1}{4}$, $\frac{1}{8}$, ect. of $f_T$) from the corresponding frequency division stages may be respectively derived. The output signal $f_o$ of the gate circuit 38 is the reference frequency signal, and is supplied to the comparator circuit 20 in FIG. 2.

On the other hand, the circuitry for forming the frequency division ratio date DS to be supplied to the variable frequency divider 34 is provided with a decoder 40 and a read only memory (ROM) 42. The decoder 40 receives from the frequency assignment operation circuit 16 in FIG. 2 with the frequency specifying signal FS including the note specifying signal TC, and it is adapted to produce a data readout address signal for the ROM 42 in accordance with the combination of the note, the pitch deviation, the octave and the tuning curve.

The ROM 42 stores the frequency division ratio data which is necessary for obtaining the reference frequencies corresponding to the twelve notes C, C# . . . and B of one octave according to the equal temperament. These note frequencies of the equal temperament are specified by the note specifying signals NT. The ROM 42 also stores for the respective notes the frequency division ratio data modified in accordance with the alterations of the pitches and tuning curves. Each time the output signal of the decoder 40 assigns a specified readout address, the frequency division ratio data in the address is read out. That is, the frequency division ratio data corresponding to the respective notes of the top octave are read out from the ROM 42 in correspondence with the pitch deviation or the tuning curve assigned by the frequency specifying signal FS, while regarding the notes having other frequencies than those according to the equal temperatment, the frequency division ratio data for equal temperament top octave to corrections in accordance with the specified pitch deviation or tuning curve are stored in the ROM 42 for the respective notes, whereby the frequency division ratio data DS is formed by the data read out.

Figure 3:
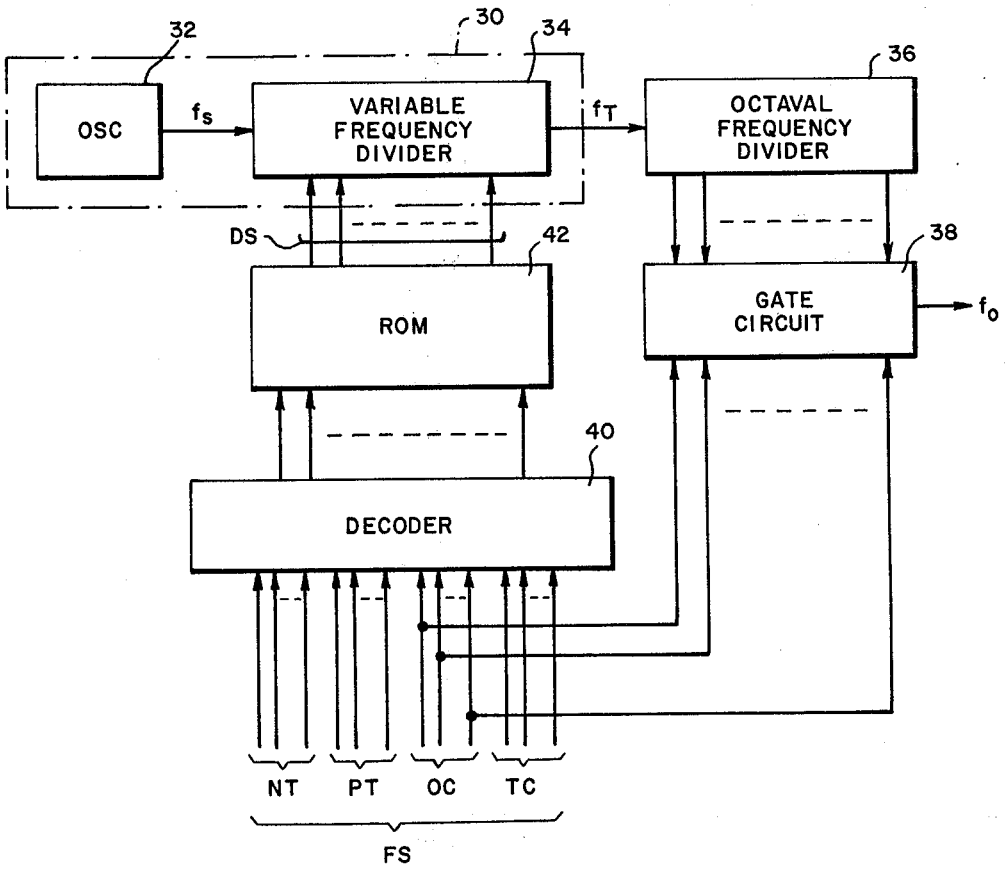
FIG. 3 is a circuit diagram showing a reference frequency signal generator used in the apparatus of FIG. 2.

Here, assuming that the value indicated by the frequency division ratio data DS from the ROM 42 has increased from N to (N+1), the ratio of (N+11)/N determine the degree of adjacency between the immediately adjacent frequencies concerning the specified notes in the circuit of FIG. 3. More specifically, in order to obtain frequencies at intervals of x cents, the following is the required condition in view of the definition of the cent value:

$$2^{\frac{x}{1200}} \geqq \frac{N+1}{N}$$

Letting $f_m$ denote the desired maximum frequency and $f_s$ the oscillation source frequency, $f_m \leqq f_s/N$ holds. Therefore, supposing x to be 1 cent and $f_m$ to be about 4 kHz corresponding to the note $B_7$, $N>1730$ and $f_s>6.9$ MHz hold. Accordingly, the quartz oscillation frequency of the OSC 32 is set at $f_s>6.9$ MHz. as the variable frequency divider circuit 34 a 12-bit programmable counter bits in necessary because in spite of $N>1730$ the frequency ratio between $B_7$ and the lowest note $C_7$ within the same octave as that of $B_7$ is nearly double. Further, when it is intended to tune the 88 keys of a piano with $n_1$ sorts of tuning curves and $n_2$ sorts of pitches, data of 12 bits amount to $88 \times n_1 \times n_2$ words, and the ROM 42 is required to have such a memory capacity as mentioned above.

Next, the details of another reference frequency signal generator circuit 18' will be described with reference to FIG. 4 wherein numerals 30, 32, 34, 36 and 38 denote the same elements as in FIG. 3. The circuit 18' differs from one shown in FIG. 3 in that the circuitry for forming the frequency division ratio data DS to be supplied to the variable frequency divider circuit 34 comprises read only memories (ROMs) 44, 48 and 52, decoders 56 and 50 and full adders 54 and 56. The circuitry is supplied from the frequency assignment operation circuit 16 in FIG. 2 with the note specifying signal NT, the pitch deviation specifying signal PT, the octave specifying signal OC and the tuning curve specifying signal TC.

The ROM 44 stores the frequency division ratio data which are necessary for obtaining the reference frequencies of the top octave according to the equal temperament which are specified by the note signals NT, and each time the note signal NT specifies a note, the frequency division data corresponding to that note is read out. Although, in this example, the note signal NT is not encoded, the note signal NT may well be encoded, and that case, it may be applied to the ROM 44 through a suitable decoder.

The decoder 46 serves to form an address signal for ROM 48 on the basis of the note signal NT and the pitch deviation signal PT, and it is adapted to assign a data readout address of the ROM 48 in accordance with the combination of the note and the pitch. The pitch deviation may be different for every note in an octave. The ROM 48 stores modification data for the frequency division ratio data of the ROM 44 for the respective notes in an octave in correspondence with pitches to be specified by the pitch deviation signals PT, and in response to the address signal from the decoder 46, the modification data on the assigned pitch is read out for every note in an octave.

The decoder 50 serves to form an address signal for the ROM 52 on the basis of the note signal NT, the octave signal OC and the tuning curve signal TC, and it is adapted to assign a data readout address of the ROM 52 in accordance with the combination of the note, the octave and the tuning curve. Here, the tuning curve signal is a kind of pitch deviation information to plot the tuning curves other than the equal temperament, which curves have a non-linear relationship relative to the equal temperament as shown in FIG. 1 so that the octave signal OC is also required to define the pitch of a note according to a certain tuning curve. The ROM 52 store modification data for the frequency division ratio data of the ROM 44 for the respective notes of each octave in correspondence with tuning curves to be assigned by the tuning curve signals TC, and in response to the address signal from the decoder 50, the modification data on the assignment tuning curve is read out for every note of each octave.

The modification data respectively read out from the ROM's 48 and 52 are added to each other by the full adder 54, and sum data from the full adder 54 is supplied to the full adder 56 as one addition input thereof. As the other addition input of the full adder 56, the frequency division data corresponding to the equal temperament read out from the ROM 44 is supplied, and the full adder 56 forms the frequency division ratio data DS by totalizing both the addition inputs. Since the frequency division ratio data DS is formed by adding the modification data on the pitch or the tuning curve to the frequency division ratio data of the top octave, it indicates a quantity in which the frequency division ratio corresponding to each note of the top octave has been modified in the light of the pitch or the tuning curve. In case where it is desired to obtain reference frequencies corresponding to the equal temperament characteristics specified by the data stored in the ROM 44 (as indicated by symbol 1 in FIG. 1), the output data of the ROM 44 need not be subjected to any correction.

Figure 4:
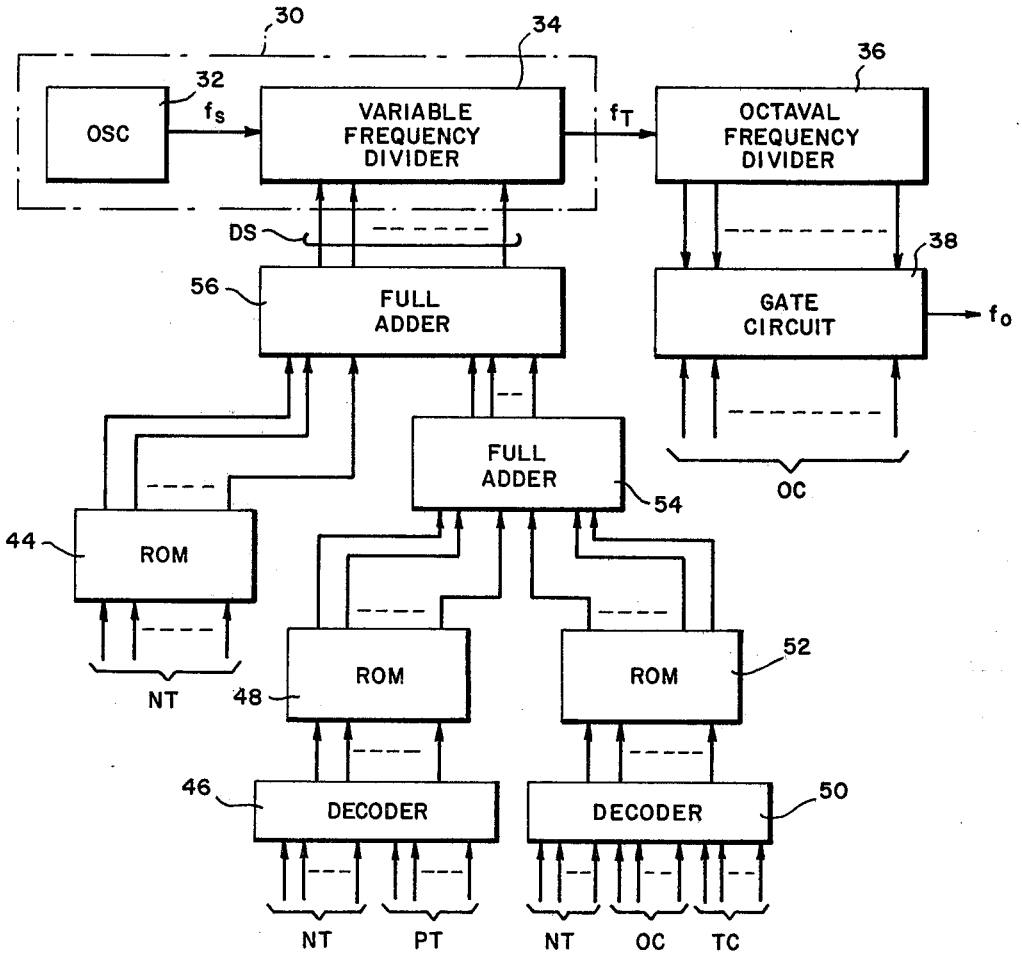
FIG. 4 is a circuit diagram showing another embodiment of a reference frequency signal generator used in the apparatus of FIG. 2.

In accordance with the circuit 18' as mentioned above, the frequency division ratio data corresponding to the 12 tones of the top octave are stored in the ROM 44, while the modification data for the frequency division ratio data are stored in the ROM's 48 and 52, and the data from the ROM's 44, 48 and 52 are digitally operated, thereby to form the frequency division ratio data DS corresponding to the assigned notes, and hence, the memory capacities of the ROM's 44. 48 and 52 may be very small, which makes it possible to put the circuit of FIG. 4 into a one-chip IC except quartz oscillator and the like.

More specifically, the ROM 44 may be of such a memory capacity that data of 12 bits for the respective 12 notes can be stored. Since the ROM 48 is provided in order to modify the pitch of each note specified by the ROM 44, the ROM 48 need not store data on the pitch specified by the ROM 44 and its memory capacity may be smaller to that extent. In order to simplify the circuit, the pitch specified by the ROM 44 may be treated in the ROM 48 as a maximum or minimum. Thus, the signs of the data stored in ROM 48 can be unified into either plus or minus. By way of example, in case where the pitch is changed in 6 stages ($n_2=6$) from 440 to 445 Hz in about 20 cents, and hence, 6 bits suffice as the number of bits of the data. Accordingly, the memory capacity of the ROM 48 in this case may be 6 bits$\times$5 (the number of stages of pitch adjustment)$\times$12 (notes). Further, the ROM 52 stores the pitch deviations from the equal temperament characteristics (symbol 1 in FIG. 1) as the modification data and need not store the data corresponding to the equal temperament itself and hence, its memory capacity may be smaller to that extent. In the example of the piano, deviations of approximately $\pm 30$ cents with respect to the equal temperament need to be produced. Therefore, about 7 bits are necessary as the number of data bits, and 1 bit of them is used for expressing the sign. Accordingly, the memory capacity of the ROM 52 in this case may be 7 bits$\times$83(keys)$\times$m (corresponding to $n_1-1$).

Now, the full adder 54 functions to operate the data from the ROM's 48 and 52 and therefore suffices with 6 bits. While various methods may be considered as the method of operating the data of the ROM's 44, 48 and 52, it is advantageous from the viewpoint of reducing the number of bits that the data of the ROM's 48 and 52 are operated in advance as in this example. In addition, in order to make the operations possible with only the adder without using an adder/subtractor, it is more preferable that minus data stored in ROM's 48 and 52 are converted into ones expressed by complements in advance. Since the full adder 56 functions to add the data of 12 bits from the ROM 44 and the data of 6 bits from the full adder 54, an adder of 12 bits suffices for the adder 56. On account of the difference of the numbers of bits of the full adders 54 and 56, upper bits of one input of the full adder 56 are in excess. However, it is possible to dispense with the subtraction function of the full adder 56 otherwise required by appropriately controlling the full adder 56 depending upon the signs of the data within the ROM's 48 and 52 or the state of the full adder 54.

By way of example, in case where the circuit of FIG. 4 was embodied so as to generate reference frequency signals at intervals of $\pm 1$ cent in order to tune the 88 keys of a piano with 3 sorts of tuning curves and 6 sorts of pitches, the memory capacity could be reduced as much as about 90% in comparison with that in the case of storing the frequency division ratio data in one ROM, and also the decoders could be miniaturized. Therefore, the circuit of FIG. 4 could be integrated in an IC (LSI)

within a single semiconductor chip except that the quartz oscillator and some components for the tuning thereof were externally mounted, and the tuning apparatus of FIG. 2 was made small in size and light in weight to the extend that it was in the palm of a hand as a whole.

Figure 5:
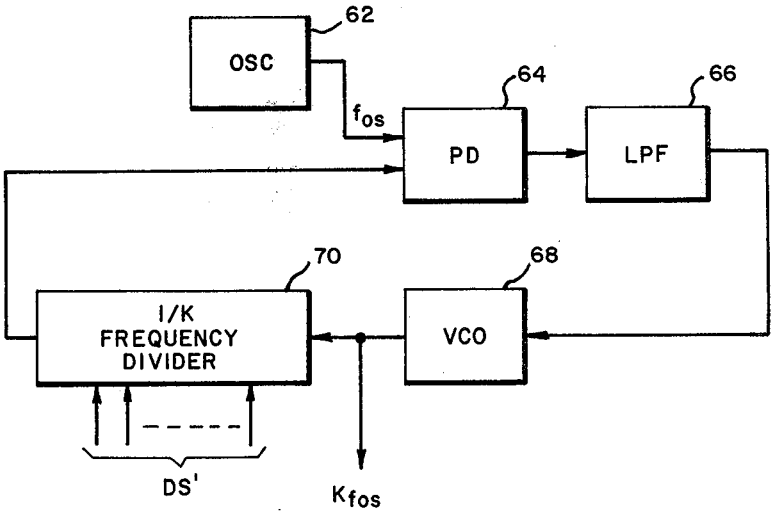
FIG. 5 is a circuit diagram showing another variable frequency oscillator circuit usable in the circuit of FIGS. 3 or 4.

FIG. 5 shows another variable frequency oscillator circuit 60 which is usable in the circuit of FIGS. 3 or 4. Numeral 62 designates a stable fixed oscillator (OSC) such as quartz oscillator, numeral 64 is a phase detector (PD) one input terminal of which is supplied with a frequency signal $f_{os}$ from the OSC 62, numeral 66 a low-pass filter (LPF) which removes a ripple component from an output signal of the PD 64 and provides a d.c. output, numeral 68 a voltage-controlled variable frequency oscillator (VCO) which has its oscillation frequency controlled by the output signal of the LPF 66 and oscillates at a frequency being K times higher than the output frequency $f_{os}$ of the OSC 62, and numeral 70 a frequency divider which is constructed of a programmable counter adapted to divide the frequency of the frequency signal from the VCO 68 by K, the frequency division output of the frequency divider 70 being fed to the other input terminal of the PD 64. That is the circuit of FIG. 5 operates as a frequency multiplier circuit employing a PLL (phase locked loop), and the frequency multiplication output $K \cdot f_{os}$ which is stable is provided from the output terminal of the VCO 68. In using this circuit in the circuit of FIG. 3 or 4, data DS' indicative of the frequency multiplication ratio K are applied as control inputs of the frequency divider 70. The multiplication ratio data DS' can be formed by the circuit of FIGS. 3 and 4, and to this end, the data of the ROMs 42, 44, 48 and 52 are redetermined concerning the multiplication ratios of K.

As described above in detail, according to the reference frequency signal generator for a tuning apparatus of this invention, the excellent functional effects as listed below are achieved:

(1) In spite of the single circuit, many functions are performed. That is, reference frequencies corresponding to any desired notes of any desired octaves are obtained in accordance with the equal temperament characteristic, various pitches or various tuning curves. This makes it possible to sharply reduce time and labor required for the tuning.

(2) Since the reference frequency signal generator comprises a stable fixed oscillator and digital circuitry in combination, the stability and precision of its operation is high, so that for example, a tuning on the extend of +1 cent having heretofore been impossible can be stabily carried out.

(3) The frequency change ratio (frequency division ratio or multiplication ratio) data are formed by combining a plurality of ROM's and arithmetic circuitry, so that in comparison with a case of storing them in and reading them out from a single ROM, the memory capacity may be much smaller, also peripheral circuitry becoming simpler to permit a sharp miniaturization of a reference frequency signal generator, which is very advantageous for constructing the entire tuning apparatus to be compact and light in weight.

(4) By appropriately subjecting to octave frequency divisions frequency signals formed for the respective notes of the top octave, reference frequencies corresponding to the respective notes of the lower respective octaves are obtained. As compared with a case where reference frequencies are directly obtained in correspondence with the respective notes of all the octaves, the circuit arrangement is greatly simplified, which is very advantageous for rendering the tuning apparatus small in size and light in weight.

We claim:

1. A reference frequency signal generator for a tuning apparatus which selectively generates reference frequency signals in accordance with at least one tuning characteristic, comprising:

means for producing a source signal having a fixed frequency;

frequency varying means receiving said source signal to produce a reference frequency signal of a target frequency through frequency calculation with respect to said source signal, said frequency varying means carrying out said frequency calculation in accordance with calculation data which represents factors for said frequency calculation;

storage means which comprises a first storage section for storing fundamental data corresponding to frequencies of respective notes in at least one octave in a musical scale, a second storage section for storing modification data for said respective notes designating pitch deviations within an octave from the frequencies corresponding to said fundamental data and a third storage section for storing tuning curve data for selectively specifying tuning characteristics covering plural octaves to form a tuning curve;

an arithmetic operation means coupled to said storage means for producing said calculation data in response to said fundamental data, said modification data and said tuning curve data supplied thereto; and accessing means for producing an access signal for accessing said first storage section, said second storage section and said third storage section to read out the fundamental data, the modification data and the tuning curve data addressed by said access signal and supplied to said rhythmatic operation means whereby said frequency varying means produces the reference frequency signal having a target frequency specified by said access signal.

2. A reference frequency signal generator for a tuning apparatus according to claim 1, wherein said frequency varying means comprises a variable frequency divider for carrying out said frequency calculation in accordance with said calculation data and an octaval frequency divider for subjecting a frequency signal fed from said variable frequency divider to a frequency division in octave thereby to produce the reference frequency signal in a desired octave.

3. A reference frequency signal generator for a tuning apparatus according to claim 2, wherein said first storage section of the storage means stores the fundamental data which comprises frequency data corresponding to respective notes in a top octave according to an equal temperament scale.

4. A reference frequency signal generator for a tuning apparatus according to claim 1, wherein said frequency varying means comprises a variable frequency multiplier circuit employing a phase lock loop for carrying out said frequency calculation in accordance with said calculation data and an octaval frequency divider for subjecting a frequency signal fed from said variable frequency multiplier circuit to a frequency division in octave thereby to produce the reference frequency signal in a desired octave.

5. A reference frequency signal generator for a tuning apparatus according to claim 1, wherein said fundamental data, said modification data and said tuning curve data are digital numerical values and said arithmetic operation means comprises one or more adder circuits.

6. A reference frequency signal generator for a tuning apparatus according to claim 1, wherein said means for producing a source signal comprises a quartz oscillator.

* * * * *